US005379465A

United States Patent [19]

Vaughn

[11] Patent Number: 5,379,465

[45] Date of Patent: Jan. 10, 1995

[54] ATTACHMENT FOR A TOILET

[76] Inventor: Gene A. Vaughn, 2036 Fountain Inn Rd., Woodruff, S.C. 29388

[21] Appl. No.: 140,506

[22] Filed: Oct. 25, 1993

[51] Int. Cl.[6] ..... A47K 13/04

[52] U.S. Cl. ..... 4/246.1; 4/248

[58] Field of Search ..... 4/236, 240, 241, 246.1, 4/248; 16/303, 306, 375, 289, 286

[56] References Cited

U.S. PATENT DOCUMENTS

| | | | |
|---|---|---|---|
| 522,324 | 7/1894 | Kelly | 4/241 |
| 719,925 | 2/1903 | White | 4/241 |
| 952,956 | 3/1910 | Spalding | 4/241 |
| 953,382 | 3/1910 | Spalding | 4/241 |
| 2,305,147 | 12/1942 | Deal | 4/241 |
| 2,877,469 | 3/1959 | Johnson | 4/241 |
| 3,805,322 | 4/1974 | Serrano | 16/85 |
| 4,069,546 | 1/1978 | Reichlin . | |
| 4,195,372 | 4/1980 | Farina | 4/240 |
| 4,965,890 | 10/1990 | Fischer | 4/240 |

FOREIGN PATENT DOCUMENTS

| | | | |
|---|---|---|---|
| 1952906 | 4/1971 | Germany | 4/241 |

*Primary Examiner*—Henry J. Recla
*Assistant Examiner*—Charles R. Eloshway
*Attorney, Agent, or Firm*—Ralph Bailey

[57] ABSTRACT

An attachment for a toilet includes a bracket (A) for securing the attachment to a rim of a toilet bowl positioning a flat spring (B) constructed of resilient flexible material extending beyond the rim and over the open top beneath an overhanging portion of the seat for carrying an upwardly extending protuberance (C) for partially raising the seat due to the force of the flexible material which permits proper lowering of the seat when in use for avoiding wetting of the seat.

8 Claims, 2 Drawing Sheets

ATTACHMENT FOR A TOILET

BACKGROUND OF THE INVENTION

This invention relates to an attachment for use in connection with a toilet seat to maintain the toilet seat in partially raised position when not otherwise in use, thereby prompting the user to raise the seat to prevent wetting of the seat.

Problems have been encountered especially in kindergarten and the early school grades where boys fail to raise the toilet seat resulting in wetting of the seat. Such problems are also encountered in hospitals and institutions where users can't, cannot or will not raise the seat of the toilet to avoid wetting the seat. This problem has become more pronounced in view of the increasing fears regarding the spreading of disease.

The prior art includes attachments to toilet seats such as is illustrated in U.S. Pat. No. 719,925 wherein spaced springs are carried by the seat to prevent violent impact with the bowl when the seat is allowed to fall. Other prior art patents illustrating the state of the art include U.S. Pat. Nos. 522,324, 952,956 and 953,302.

SUMMARY OF THE INVENTION

Accordingly, it is an important object of the present invention to provide an attachment for use in connection with a toilet seat for prompting the user to either raise the seat avoiding wetting of the seat or to permit lowering of the seat fully for use in lowered position.

Another object of the invention is to provide an attachment for avoiding the wetting of the toilet seat which will operate automatically to maintain the seat in partially raised position except when in use in order to avoid wetting of the seat.

Another important object of the invention is to provide an attachment for avoiding the wetting of a toilet seat including a bracket for securing the attachment to the rim of a toilet bowl, a flat spring carrying a protuberance or camming member adjacent a free end of the spring extending over the rim for urging the seat into partially raised position while permitting downward flexing of the spring when the seat is lowered and in use.

The present invention is directed to an apparatus that satisfies these needs. An attachment for avoiding wetting the seat of a toilet having features of the present invention comprises a bracket and a flat spring attached to the bracket. The flat spring is constructed of resilient flexible material and extends horizontally toward the front of the bowl beneath the seat. A protuberance extends upward from the free end of the spring and contacts the underside of the seat when the seat is lowered. The spring's resistance causes the seat to remain partially elevated when lowered, but is sufficiently flexible to permit the seat to be fully lowered when required of a sitting user.

The attachment produces a condition which prompts a standing user to raise the seat to avoid wetting the seat top, and which permits a sitting user to fully lower the seat when necessary.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate an attachment for avoiding wetting the seat of a toilet having a bowl with a rim defining an open top. The seat has an overhanging portion extending beyond the rim over a rear portion of the open top, and a hinge connects the seat to the bowl at a rear portion of the bowl. Threaded means connect the hinge to the rim. A bracket A is secured to the rim beneath the seat. A flat spring B is constructed of resilient flexible material fixed to the bracket extending in a substantially horizontal plane beyond the rim and over the open top beneath the overhanging portion of the seat. An upwardly extending protuberance C is fixedly carried by a free end of the spring opposite the bracket engaging an underside of the overhanging portion of the seat and maintaining the seat in partially elevated position. The flat spring has sufficient resistance to downward flexing to raise and to maintain said seat in partially elevated position while being sufficiently yieldable to permit the seat to be fully lowered when in use. Thus, a user is prompted to either raise the seat fully avoiding wetting the seat or to exert a downward force on the protuberance flexing the spring downwardly fully lowering the seat and maintaining the seat in said lowered position when supporting the user in a sitting position. Preferably, the bracket has spaced holes therein to accommodate the threaded means for fixing the bracket to the rim, and the bracket, spring, and protuberance are integral members.

Figure 1:
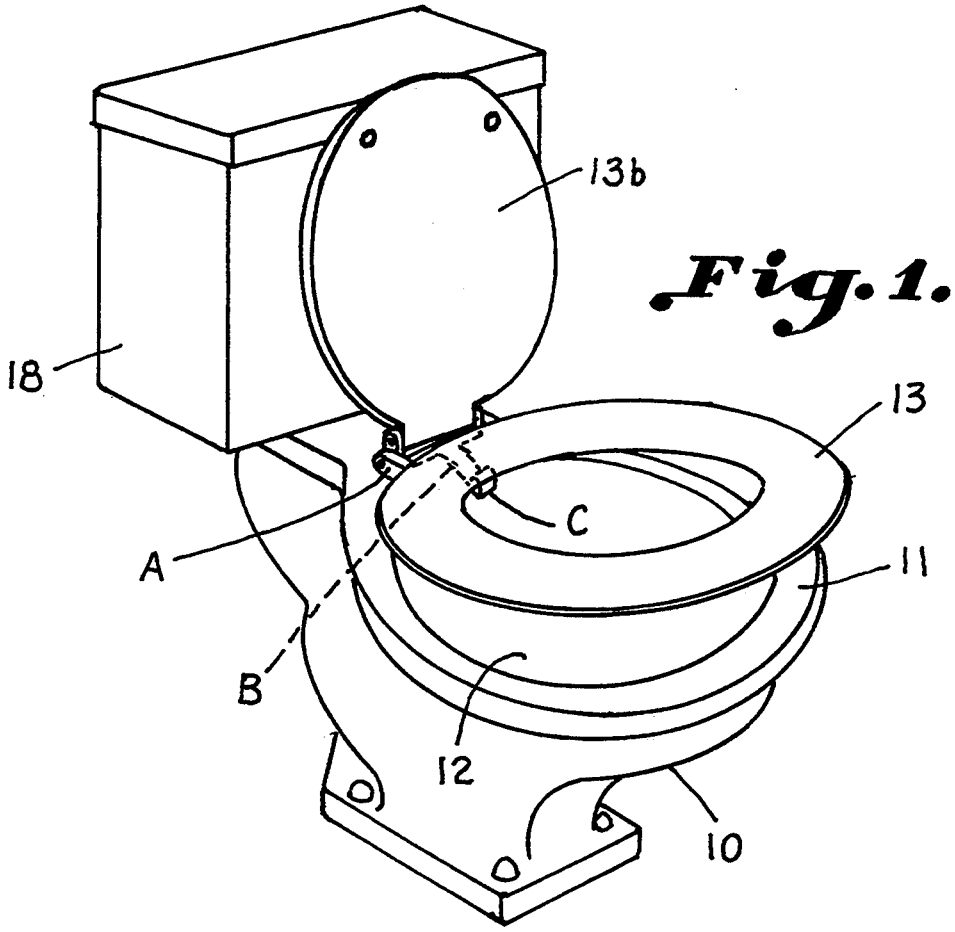
FIG. 1 is a perspective view illustrating a toilet seat equipped with an attachment constructed in accordance with the present invention positioning the toilet seat in partially raised position when not in use.
Figure 2:
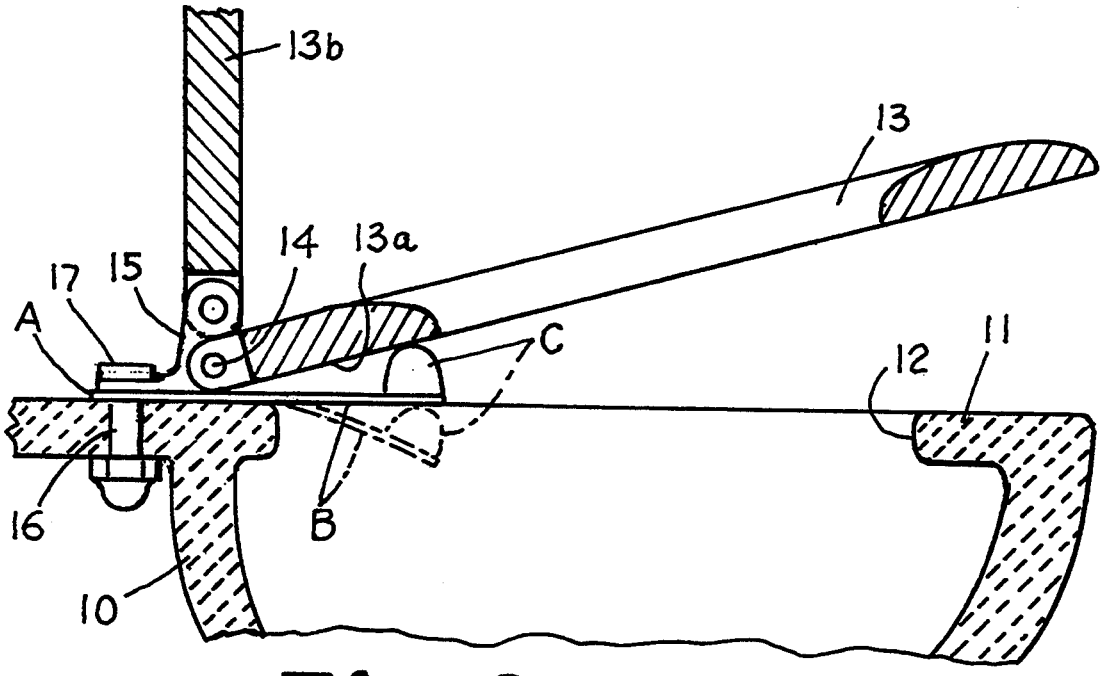
FIG. 2 is a longitudinal sectional elevation taken on the line 2—2 in FIG. 1.
Figure 3:
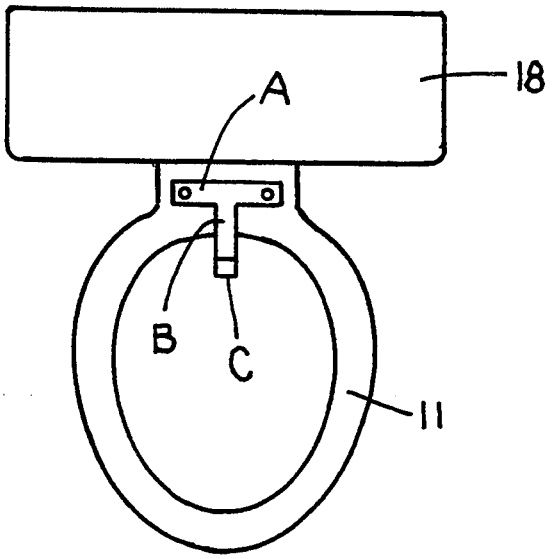
FIG. 3 is a top plan view illustrating the positioning of the attachment at the rear of the bowl of a toilet.

FIGS. 1 and 2 illustrate the attachment positioned for use upon a toilet having a bowl 10 with a rim 11 defining an open top at 12. A seat 13 is illustrated in partially raised position having an overhanging portion **13*a* for engagement by an upwardly projecting portion C of the attachment for maintaining the seat in partially raised position. The overhanging portion 13*a* is an extension of an under side of the seat which overlies the rear portion of rim 11. The seat 13 is illustrated in FIG. 2 as being pivotally mounted as at 14 upon the usual bracket 15. The bracket 15 is secured to the toilet bowl as by the usual spaced upwardly extending threaded members 16 embedded in the rim and having a threaded upper extension 17 threadably receivable within the bracket 15. In FIG. 2 the seat 13 is illustrated in partially raised position. The attachment is illustrated in solid lines maintaining the seat in partially raised position while the attachment is flexed downwardly as shown in broken lines when depressed by the seat when in fully lowered position. The toilet is illustrated as further including the usual flush tank 18 and seat cover 13***b*.

The attachment includes a bracket A illustrated as an elongated rectangular member having outwardly projecting portions 19 on each side of the flat spring B. Openings 20 are provided in each of the outwardly projecting portions 19 for receiving the threaded members 17 for connecting the hinge to the rim of the toilet bowl beneath the seat.

Figure 4:
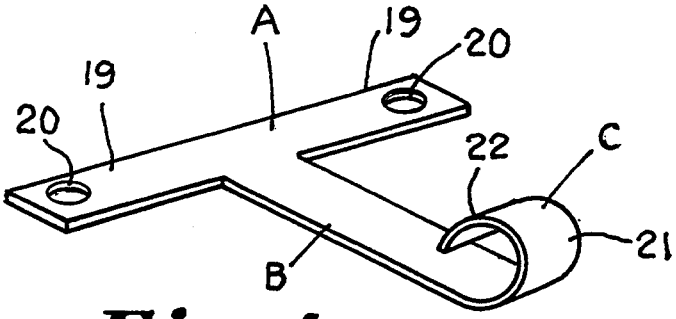
FIG. 4 is a perspective view illustrating an attachment constructed in accordance with the invention wherein an integral construction preferably of metal is utilized.

Referring further to FIG. 4, the flat spring B is integrally connected to the bracket portion and is preferably constructed of resilient metal such as a leaf spring. The flat spring B is turned upwardly at a free end as at 21 and is extended rearwardly as at 22 defining an upward extending protuberance or cam member C. Preferably, the entire attachment is integrally constructed of metal such as a metal stamping which is turned upwardly at a free end of the spring. The upturned portion 21 may flex and aid in supporting while permitting lowering of the seat.

Figure 5:
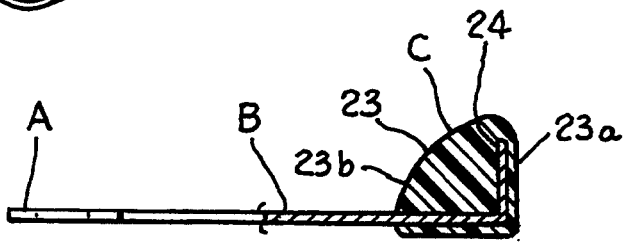
FIG. 5 is a longitudinal sectional elevation illustrating a modified form of the invention wherein a camming member is attached on a free end of the metallic spring.

FIG. 5 illustrates a modified form of the invention wherein the protuberance is formed by a plastic camming member 23 which extends upwardly as at 23*a* and is curved rearwardly and downwardly as at 23*b*. The protuberance 23 is suitably secured as by molding same about an upturned portion 24 of the spring B.

Figure 6:
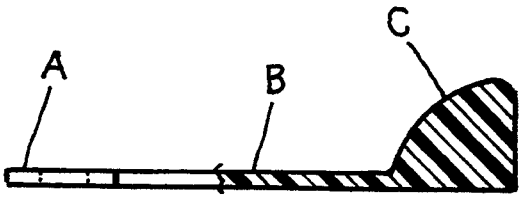
FIG. 6 is a longitudinal sectional elevation illustrating a further modified form of the invention wherein the attachment is of unitary construction of molded plastic.

FIG. 6 is a further modified form of the invention wherein the entire attachment is integrally molded of suitable plastic such as polyethylene as by injection molding.

It is thus seen that an attachment has been provided wherein a leaf spring like member has sufficient resiliency to maintain the seat in partially raised position when in use and yet which permits lowering for use of the seat when the user is in a sitting position. Thus, wetting of the seat by a user urinating in standing position is avoided but which at all times automatically operates to encourage raising the seat at the proper time to avoid wetting the seat.

While a preferred embodiment of the invention has been described using specific terms, such description is for illustrative purposes only, and it is to be understood that changes and variations may be made without departing from the spirit or scope of the following claims.

What is claimed is:

1. An attachment for avoiding wetting the seat of a toilet having a bowl with a rim defining an open top, said seat having an overhanging portion extending beyond said rim over a rear portion of said open top, a hinge connecting said seat to said bowl at a rear portion of said bowl, and a threaded means connecting said hinge to said rim, the improvement comprising:

a bracket secured to said rim beneath the seat;

a flat spring constructed of resilient flexible material fixed to said bracket extending in an unflexed state so as to exert no resilient force against said seat and being out of engagement therewith when said seat is fully raised, said spring extending beyond said rim and over said open top beneath said overhanging portion of said seat;

an upwardly extending protuberance carried by a free end of said spring opposite said bracket engaging an underside of said overhanging portion of said seat and maintaining said seat in partially elevated position; and said flat spring having sufficient resistance to downward flexing to yieldably support the weight of said seat bearing against a flat side of the spring to thereby maintain said seat in said partially elevated position exerting sufficient resilient force to support the weight of said seat and being sufficiently yieldable to permit said seat to be fully lowered against the force of said spring when in use;

whereby a user is prompted to either raise the seat fully avoiding wetting the seat or to exert a downward force on the protuberance flexing the spring downwardly fully lowering the seat and maintaining the seat in said lowered position when supporting the user in a sitting position.

2. The structure set forth in claim 1 wherein said bracket has spaced holes therein to accommodate said threaded means for fixing said bracket to said rim.

3. The structure set forth in claim 2 wherein said protuberance is constructed of plastic and fixedly attached to said free end of said spring.

4. The structure set forth in claim 2 wherein said bracket, spring and protuberance are integral members.

5. The structure set forth in claim 4 wherein said integral members are constructed of resilient metal.

6. The structure set forth in claim 4 wherein said integral members are constructed of resilient plastic.

7. The structure set forth in claim 1 wherein said spring has an upturned rearwardly extending member forming said protuberance at said free end of said spring.

8. The structure set forth in claim 1 wherein said protuberance is fixedly carried by said free end of said flat spring.

* * * * *